US006260722B1

(12) United States Patent
Ekkert

(10) Patent No.: US 6,260,722 B1
(45) Date of Patent: Jul. 17, 2001

(54) CAP AND CONTAINER ASSEMBLY

(75) Inventor: Len Ekkert, Lemont, IL (US)

(73) Assignee: Phoenix Closures, Inc., Naperville, IL (US)

( * ) Notice: Subject to any disclaimer, the term of this patent is extended or adjusted under 35 U.S.C. 154(b) by 0 days.

(21) Appl. No.: 09/531,858

(22) Filed: Mar. 21, 2000

Related U.S. Application Data

(63) Continuation-in-part of application No. 09/475,301, filed on Dec. 29, 1999.

(51) Int. Cl.[7] ..... B65D 41/04; B65D 53/00

(52) U.S. Cl. ..... 215/331; 215/44; 215/45; 215/341; 215/354

(58) Field of Search ..... 215/43–45, 329, 215/331, 341, 343, 344, 354, DIG. 1, 330; 220/288, 304

(56) References Cited

U.S. PATENT DOCUMENTS

| | | | |
|---|---|---|---|
| D. 35,412 | 12/1901 | Lorenz . | |
| D. 228,879 | 10/1973 | Plummer . | |
| D. 236,433 | 8/1975 | Strand . | |
| D. 262,266 | 12/1981 | Hadtke et al. . | |
| D. 274,218 | 6/1984 | Aramski . | |
| D. 285,657 | 9/1986 | Poore . | |
| D. 345,695 | 4/1994 | Frazer et al. . | |
| D. 345,696 | 4/1994 | Wilkinson et al. . | |
| 2,768,762 | 10/1956 | Guinet . | |
| 2,829,790 | 4/1958 | Isele-Aregger . | |
| 3,074,579 | 1/1963 | Miller . | |
| 3,389,851 | 6/1968 | Clark . | |
| 3,441,161 | 4/1969 | Van Baarn . | |
| 3,568,871 | 3/1971 | Livingstone . | |
| 3,603,472 | 9/1971 | Lecinski, Jr. . | |
| 3,811,591 | 5/1974 | Novitch . | |
| 4,383,620 | 5/1983 | Mumford . | |
| 4,442,947 | 4/1984 | Banich, Sr. . | |
| 4,450,960 | 5/1984 | Johnson . | |
| 4,560,077 | 12/1985 | Dutt . | |
| 4,566,603 | 1/1986 | Moore . | |
| 4,598,835 | 7/1986 | Brownbill . | |
| 4,768,672 | 9/1988 | Pulciani et al. . | |
| 4,856,668 | 8/1989 | Pfefferkorn et al. . | |
| 4,907,709 | 3/1990 | Abe et al. . | |
| 4,928,839 | 5/1990 | Kruelskie . | |
| 4,977,002 | 12/1990 | Hoffman . | |
| 5,292,020 * | 3/1994 | Narin | 215/331 |
| 5,383,558 | 1/1995 | Wilkinson et al. . | |
| 5,722,545 * | 3/1998 | Rinne | 215/331 |
| 5,931,323 | 8/1999 | Wilkinson et al. . | |
| 6,105,801 * | 8/2000 | Minnette | 215/331 |

FOREIGN PATENT DOCUMENTS

| | | | |
|---|---|---|---|
| 38214 | 11/1969 | (AU) . | |
| 0176205 | 4/1986 | (EP) . | |
| 0423406 A1 | 4/1991 | (EP) . | |
| 2431432 | 2/1980 | (FR) . | |
| 2044736 * | 10/1980 | (GB) | 215/331 |
| 2126565 * | 3/1984 | (GB) | 215/330 |

* cited by examiner

*Primary Examiner*—Nathan J. Newhouse
(74) *Attorney, Agent, or Firm*—Welsh & Katz, Ltd.

(57) ABSTRACT

A cap and container assembly can be opened and closed repeatedly and continue to achieve a good seal between the cap and the container. The good seal results from the engagement, of the container neck with cap protrusions, which temporarily deforms the shape of the container and/or the cap as the cap is secured to the container.

15 Claims, 4 Drawing Sheets

FIG. 1
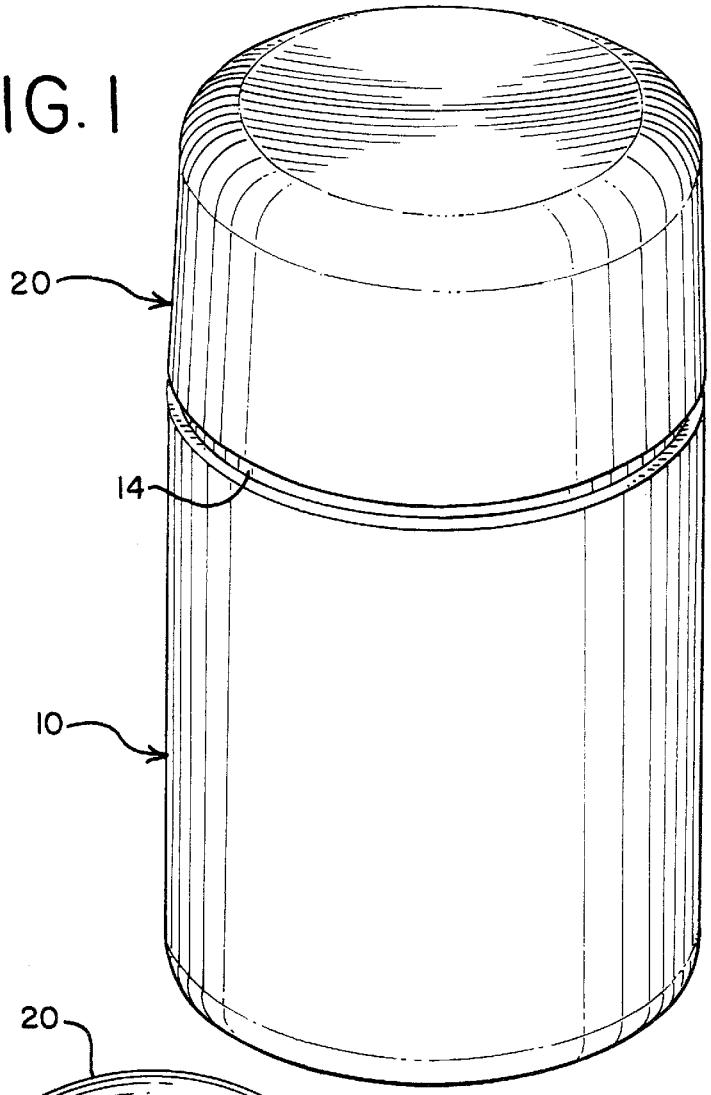
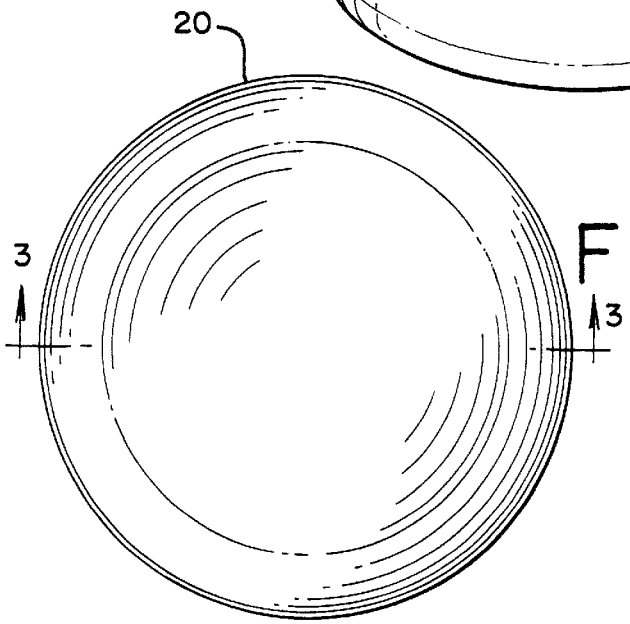
FIG. 2

CAP AND CONTAINER ASSEMBLY

This is a continuation-in-part of patent application Ser. No. 09/475,301, filed on Dec. 29, 1999.

BACKGROUND AND SUMMARY

This invention relates to containers which can be opened and closed repeatedly and continue to achieve a good seal between the cap and the container.

A good seal is especially desirable if the substance in the container needs protection from the outside environment, such as a powdered beverage mix which can cake with continuous exposure to very humid air. It is desirable to be able to manufacture an inexpensive cap and container assembly, which can be used for initial packaging of the product prior to sale, and which can continue to be opened and resealed by the purchaser of the product.

Some existing containers are too expensive for the packaging of inexpensive products, difficult to reseal effectively, or simply cannot be resealed effectively.

The present invention is a cap and container assembly which can repeatedly achieve a good seal. Annular protrusions depend from a curved cap top, and the top of the container neck slants out, then in, and then out as the neck extends down from the mouth of the container. As the cap is secured to the container, the protrusions engage exterior and interior surfaces of the neck, and the curved cap top and the upper part of the neck flex to facilitate forming a good seal. Stopping surfaces form a positive stop to lower engagement of the cap with respect to the container beyond a certain point, limiting the temporary deformation of shape caused by the flexing. The dimensions of the protrusions and the neck surfaces are matched to achieve a good seal at the lowest engagement of the cap with respect to the container permitted by the stopping surfaces.

The features of the present invention which are believed to be novel are set forth below with particularity in the claims. The invention, together with further advantages thereof, may be understood by reference to the following description in conjunction with the accompanying figures, which illustrate some embodiments of the invention.

BRIEF DESCRIPTION OF THE DRAWINGS

FIG. 1 is a side perspective view of the cap and container assembly with the cap secured to the container.

FIG. 2 is a top perspective view of the cap and container assembly.

DETAILED DESCRIPTION

FIGS. 1 through 4 show an example of the present cap and container assembly. It comprises a container 10 and a cap 20 designed for mating engagement with each other. The container 10 and cap 20 are manufactured as molded plastic parts, preferably composed of polypropylene, polyethylene, or similar materials.

Figure 3:
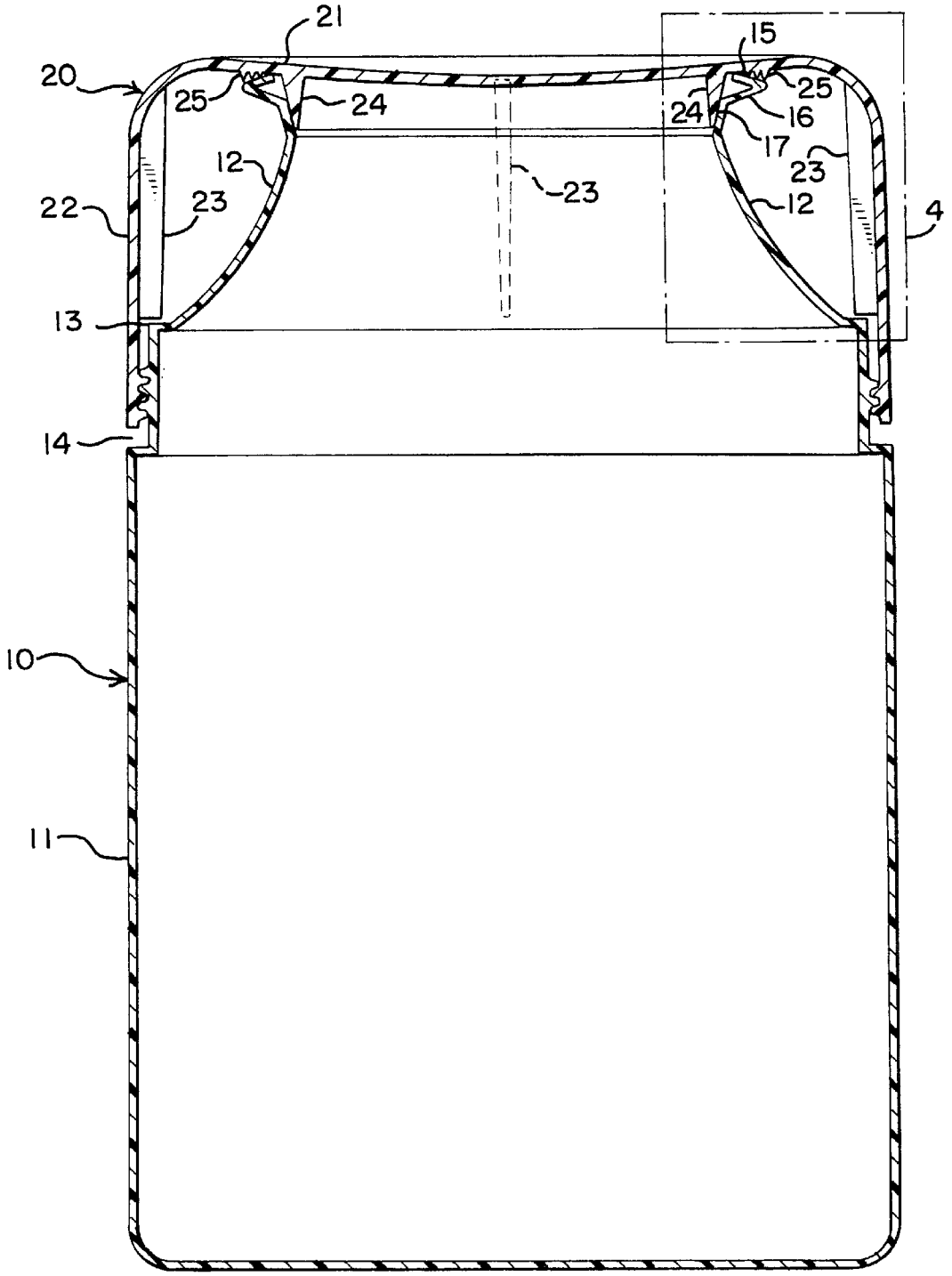
FIG. 3 is a cross-sectional view taken along line 3—3 depicted in FIG. 2.
Figure 4:
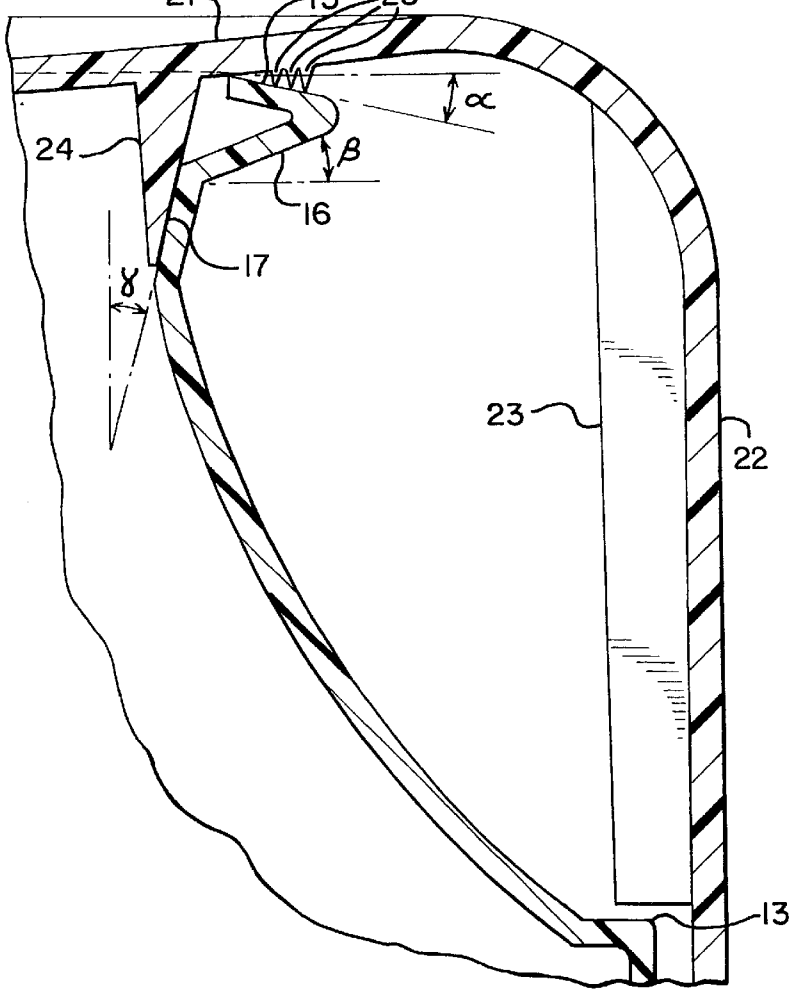
FIG. 4 is an enlarged view of the identified portion in FIG. 3.

As best seen in FIG. 3, the container 10 includes a base 11 and a neck 12. The neck 12 is the portion of the container 10 to which the cap 20 is engaged, and the end of the neck 12 defines a mouth of the container. The cap 20 includes a curved top 21 and a skirt 22 depending peripherally from the top 21. A portion of the exterior surface of the neck 12 is threaded, a portion of the interior surface of the skirt 22 is threaded, and the cap 20 can be secured to the container 10 by mating engagement of those two threaded-portions. A number of stops or projections 23 on the interior surface of the skirt 22 are designed to contact a shoulder 13 on the exterior surface of the neck 12 at a certain point as the cap 20 is secured to the container 10. Those projections 23 and shoulder 13 act as stopping surfaces to stop any lower engagement of the cap 20 with respect to the container 10 and to provide a gap 14 between a bottom edge of the cap 20 and an upper part of the base 11. In FIGS. 3 and 4, the shoulder 13 is seen above the threaded portion of the exterior surface of the neck 12.

Figure 6:
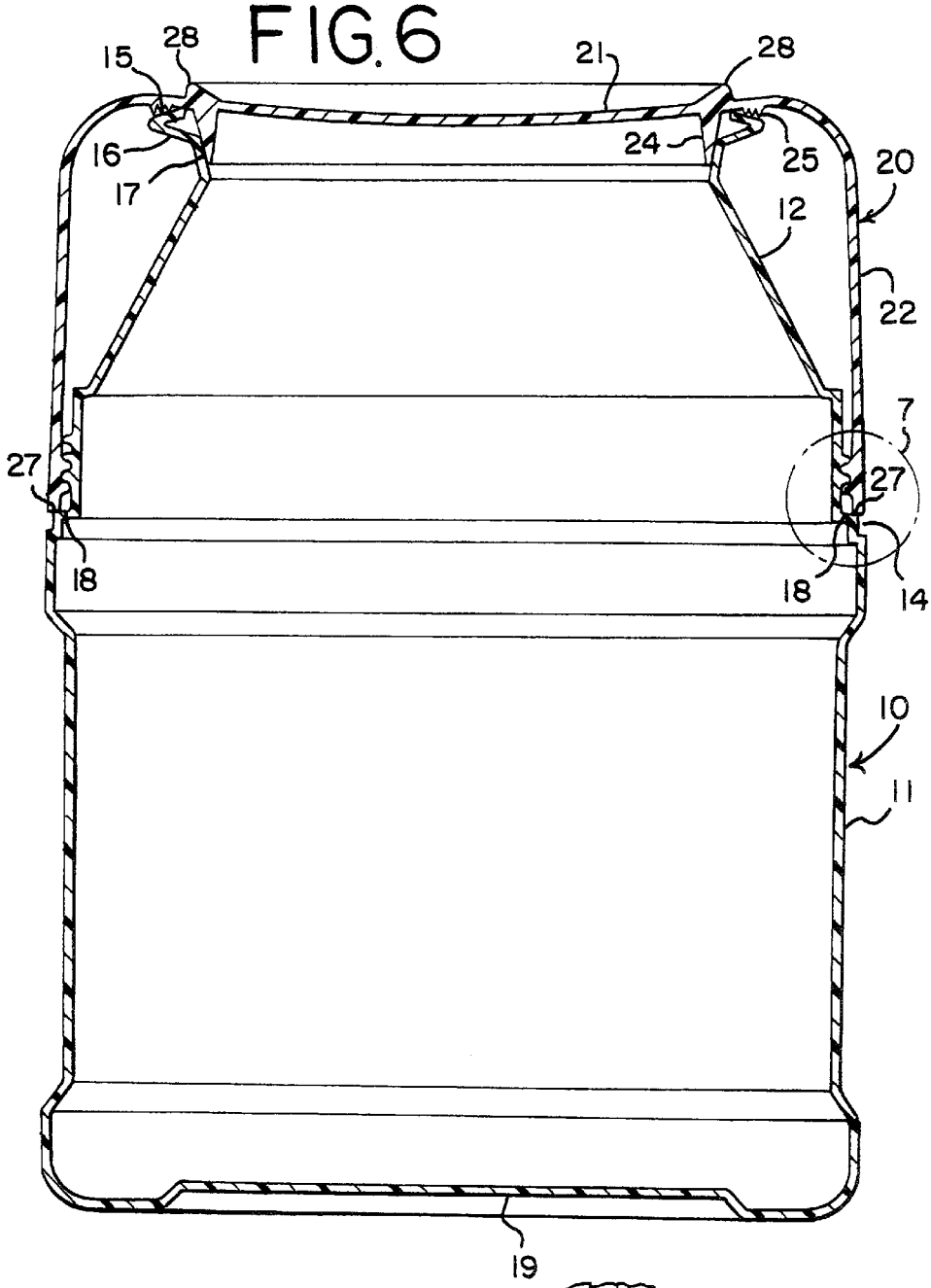
FIG. 6 is a similar cross-sectional view as illustrated in FIG. 3, but of an alternative embodiment.
Figure 7:
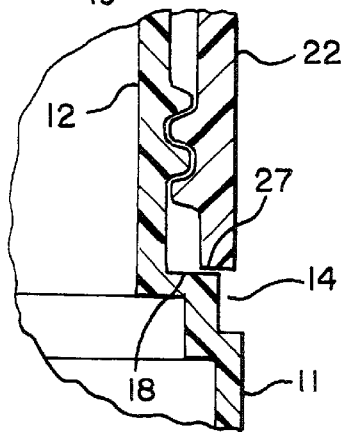
FIG. 7 is an enlarged view of the identified portion of FIG. 6.

FIGS. 6 and 7 show an example of an alternative embodiment, in which the shoulder 18 on the exterior surface of the neck 12 is below the threaded-portion. The shoulder 18 and a bottom edge 27 of the cap 20 act as stopping surfaces to stop any lower engagement of the cap 20 with respect to the container 10 to provide a gap 14 between the bottom edge 27 of the cap 20 and an upper part of the base 11.

As best seen in FIGS. 3 and 4, a relatively long sealing flange or first annular protrusion 24 and a plurality of much smaller second annular protrusions 25 depend from an interior surface of the top 21. The top 21 is generally convex as viewed from inside the cap 20. The neck 12 is substantially symmetrical about a central vertical axis. As the neck 12 extends down from the mouth, it is preferable if the neck 12 initially doubles back creating a flexible lip and then has a lower interior sealing surface 17 for sealing with the first protrusion 24, before extending down to the threaded portion. That is, the neck 12 initially becomes wider forming an upper exterior sealing surface 15 at an angle of about 100 to about 200, and preferably about 15°, with an imaginary horizontal plane in an unstressed state. The second annular protrusions 25 are positioned to engage this upper exterior sealing surface 15 of the neck 12. It is preferable that the neck 12 then become narrower first forming an exterior surface 16 at an angle of about 10° to about 25°, and preferably about 20°, with an imaginary horizontal plane, and second becoming more vertical while continuing to narrow and forming the lower interior sealing surface 17 at an angle of about 10° to about 20°, and preferably about 14°, with a surface of an imaginary vertical cylinder (in an unstressed state). The first annular protrusion 24 can engage this lower interior sealing surface 17 of the neck 12. The neck 12 can then become wider than the lip as it continues down to meet the base 11.

The surfaces 15, 16, and 17, like all of the neck 12 in the example illustrated by FIGS. 1 through 4, curve symmetrically about a central vertical axis. However, the surfaces 15, 16, and 17, may be characterized as generally frusto-conical. That is, in a cross-sectional view taken along any plane which includes the central vertical axis, the surfaces 15, 16, and 17 would appear as straight line segments. As seen in FIG. 4, the angle of surface 15, 16, or 17, mentioned above, would be the angle of such a straight line segmentαas represented by angles α, β, and γ, respectively.

With the example just described, and illustrated in FIGS. 3 and 4, the first annular protrusion 24 will protrude down further from the top 21 than the second protrusions 25, as both are designed to engage and seal with a particular surface area of the neck 12. It is preferable that materials and the geometry of the top 21, the first protrusion 24, and the neck 12 render them sufficiently flexible to allow for some temporary deformation of shape. This is facilitated by the curvature of the top 21 and the bends in the neck 12. The temporary deformation results from the pressure exerted as the cap 20 is secured to the container 10. The resilience of the materials used maintains that pressure and the resulting good seal between the cap 20 and the container 10.

It is preferable that the angles, of the first annular protrusion 24 and of the lower interior sealing surface 17 of the neck 12 with which the first protrusion 24 will engage, are generally matched to achieve a good seal at the lowest engagement permitted by the stopping surfaces 13 and 23 (or stopping surfaces 18 and 27 in the example of FIG. 6). Similarly, as seen best in FIG. 4, the lengths of the second annular protrusions 25 will vary to match the angle of the upper exterior sealing surface 15 of the neck 12 with which the second protrusions 25 will engage. Of course, the particular configurations described are only an examples and are not the only ones which will work. Upon engagement, the interior surface of the top 21 will be pressed upward, and the upper exterior sealing surface 15 will be pressed downward putting inward pressure on the lower interior sealing surface 17 and on the first protrusion 24.

In addition to facilitating a good seal, the shape of the neck 12, such as seen in FIG. 3 or in FIG. 6, is ergonomically desirable. A typical opened container 10 may be held easily with one hand around the neck 12 below the flexible lip.

As seen in FIG. 3, a bottom section of the neck 12 is generally vertical, and its exterior surface includes the threaded-portion below the shoulder 13. That bottom section of the neck 12 is narrower than the adjacent and integral upper part of the base 11, and the skirt 22 is generally the same diameter as the upper part of the base 11.

As seen in FIGS. 1 and 3, a gap 14 remains between a bottom edge of the cap 20 and an upper part of the base 11 in the illustrated embodiment, when lower engagement of the cap 20 with respect to the container 10 is blocked by contact between the stopping surfaces 13 and 23. The gap 14 facilitates the cutting of any label or tamper-evident tape applied to the filled cap and container assembly before sale to the consumer.

Similarly, in the embodiment illustrated in FIGS. 6 and 7, a gap 14 remains between a bottom edge 27 and an upper part of the base 11, when lower engagement of the cap 20 with respect to the container 10 is blocked by contact between the stopping surfaces 18 and 27.

In the example of FIG. 7, the depth of gap 14 is less than the thickness of the skirt 22. There are other ways to achieve the gap 14 using the bottom edge 27 of the cap as a stopping surface. Shoulder 18 should form a step above the upper part of the base 11, and the outer diameter of shoulder 18 should be less than the outer diameter of the adjacent upper part of the base 11. In order for shoulder 18 to act as a stopping surface and to create gap 14, the outer diameter of shoulder 18 also should be less than the outer diameter, but greater than the inner diameter, of the bottom edge 27 of the cap 20.

The embodiment illustrated in FIG. 6 shows another feature relating to the stacking of closed containers 10. An annular stacking protrusion 28 extends up from an exterior surface of the top 21 of the cap 20. The annular protrusion 28 dimensioned for mating with a circular recess 19 in an exterior surface of a bottom of the base 11 to facilitate stacking.

Figure 5:
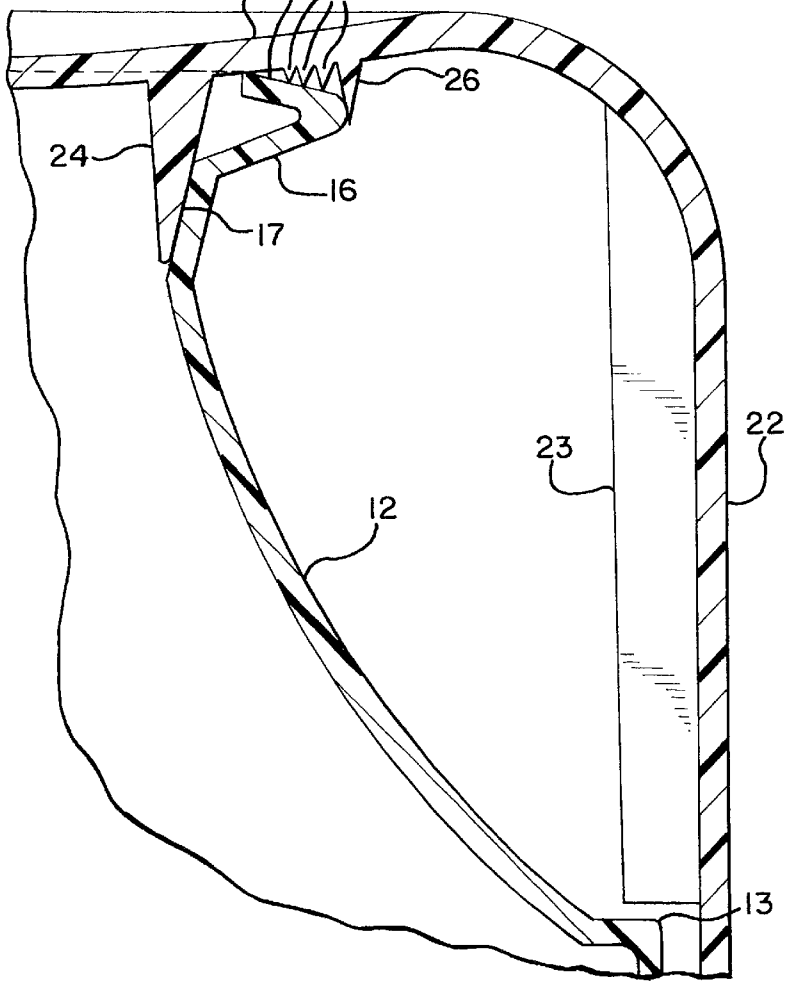
FIG. 5 is a similar view as illustrated in FIG. 4, but of an alternative embodiment.

In an alternative embodiment illustrated, in part, in FIG. 5, an additional annular protrusion 26 depends down from the interior surface of the top 21. When the cap 20 is engaged with the container 10, the additional protrusion 26 is radially outside of the flexible lip of the neck 12, and is sufficiently rigid and extends low enough and close enough to the lip to resist the lip from moving outwardly when the lip is pressed down upon engagement of the cap 20 with the container 10. The curved cap top 21 flexes up, causing the rigid additional protrusion 26 to press the flexible lip inwardly. This will maintain the pressure on the sealing surfaces 15 and 17, and improve the sealing between the upper exterior sealing surface 15 and the second protrusions 25 and between the lower interior sealing surface 17 and the first protrusion 24. The additional annular protrusion 26 will compensate for manufacturing imperfections, such as a surface of the neck 12 being slightly out of the round, which would diminish the ability to achieve a good seal. The possibility of such imperfections cannot always be eliminated given the tolerances achievable in the manufacture of inexpensive containers.

The embodiments discussed and/or shown in the figures are examples. They are not exclusive ways to practice the present invention, and it should be understood that there is no intent to limit the invention by such disclosure. Rather, it is intended to cover all modifications and alternative constructions and embodiments that fall within the scope of the invention as defined in the following claims:

What is claimed is:

1. A cap and container assembly comprising:

a container and a cap;

the container including a base, and a neck for sealing engagement with the cap, an end of the neck defining a container mouth;

stopping surfaces comprising a bottom edge of the cap and a step above an adjacent upper part of the base, the stopping surfaces engaging to form a positive stop to lower engagement of the cap with respect to the container, and a gap between the bottom edge of the cap and the upper part of the base upon engagement of the stopping surfaces.

2. A cap and container assembly as in claim 1, an outer diameter of the step being less than an outer diameter of the adjacent upper part of the base, and less than an outer diameter of the bottom edge of the cap; the outer diameter of the step being more than an inner diameter of the bottom edge of the cap.

3. A cap and container assembly as in claim 1, wherein a depth of the gap is less than a width of the bottom edge of the cap.

4. A cap and container assembly as in claim 1, wherein the sealing engagement of the cap with the neck temporarily deforms a shape of at least one of a group consisting of the cap and the neck, and wherein an extent of said deformation can be limited upon engagement of the stopping surfaces.

5. A cap and container assembly as in claim 1, the cap including at least one annular protrusion which can sealingly engage an interior surface of the neck.

6. A cap and container assembly as in claim 1, the cap including at least one annular protrusion which can sealingly engage an exterior surface of the neck.

7. A cap and container assembly as in claim 1, the cap including at least one first annular protrusion which can sealingly engage a first surface of the neck and at least one second annular protrusion which can sealingly engage a second surface of the neck.

8. A cap and container assembly as in claim 7, wherein an interior surface of the neck includes the first surface, and an exterior surface of the neck includes the second surface.

9. A cap and container assembly comprising:

a container and a cap;

the container including a base, and a neck for engagement with the cap, an end of the neck defining a container mouth;

the neck being substantially symmetrical about a central vertical axis;

the neck forming a flexible lip, proximate the mouth, with an upper, generally frusto-conical, exterior sealing surface;

the neck further forming an intermediate section below the lip with a lower, generally frusto-conical, interior sealing surface, the intermediate section being generally narrower than the lip;

the neck further forming a bottom exterior surface, of greater diameter than the diameter of the lip, for securing engagement with the cap;

the cap including a top, a skirt depending peripherally from the top, at least one first annular sealing protrusion depending from an interior surface of the top, and at least one second annular sealing protrusion depending from the interior surface of the top;

wherein, upon securing engagement of the skirt with the bottom exterior surface of the neck, the at least one first sealing protrusion sealingly engages the lower interior sealing surface, and the at least one second sealing protrusion sealingly engages the upper exterior sealing surface;

wherein stopping surfaces, comprising a bottom edge of the skirt and a shoulder on the bottom exterior surface of the neck, engage to form a positive stop to lower engagement of the cap with respect to the container; a gap remaining between the bottom edge of the skirt and an upper part of the base, upon engagement of the stopping surfaces.

10. A cap and container assembly as in claim 9, the securing engagement of the skirt with the bottom exterior surface of the neck being a threading engagement of a threaded-portion of an interior surface of the skirt with a threaded-portion of the bottom exterior surface of the neck, and the shoulder on the bottom exterior surface of the neck being below the threaded-portion.

11. A cap and container assembly as in claim 9, wherein the sealing engagement of the sealing protrusions with the sealing surfaces, respectively, temporarily deforms a shape of at least one of a group consisting of the cap and the neck.

12. A cap and container assembly as in claim 9, the top of the cap being generally convex as viewed from inside the cap.

13. A cap and container assembly as in claim 9, wherein the cap is manufactured of a flexible plastic material.

14. A cap and container assembly as in claim 9, wherein the container is manufactured of a flexible plastic material.

15. A cap and container assembly as in claim 9, the cap further including an annular stacking protrusion extending up from an exterior surface of the top of the cap; said stacking protrusion dimensioned for mating with a circular recess in a bottom of the base to facilitate stacking of closed containers.

* * * * *

UNITED STATES PATENT AND TRADEMARK OFFICE

CERTIFICATE OF CORRECTION

PATENT NO. : 6,260,722 B1
DATED : July 17, 2001
INVENTOR(S) : Len Ekkert

It is certified that error appears in the above-identified patent and that said Letters Patent is hereby corrected as shown below:

Column 2,
Line 39, delete "100", and insert therefore -- 10º --.
Line 40, delete "200", and insert therefore -- 20º --.
Line 63, delete "segmentαas," and insert therefor -- segment - as --.

Signed and Sealed this

Eighth Day of October, 2002

*Attest:*

*Attesting Officer*

JAMES E. ROGAN
*Director of the United States Patent and Trademark Office*